United States Patent [19]

Bradley

[11] 4,147,525

[45] Apr. 3, 1979

[54] PROCESS FOR LIQUEFACTION OF NATURAL GAS

[76] Inventor: Robert A. Bradley, 18 Ralston Ave., Toronto, Ontario, Canada, M4C 3L5

[21] Appl. No.: 797,549

[22] Filed: May 16, 1977

Related U.S. Application Data

[63] Continuation of Ser. No. 693,767, Jun. 8, 1976, abandoned.

[51] Int. Cl.[2] ..... F25J 3/06

[52] U.S. Cl. ..... 62/23; 62/18; 62/26

[58] Field of Search ..... 62/23–28

[56] References Cited

U.S. PATENT DOCUMENTS

| | | | |
|---|---|---|---|
| 2,557,171 | 6/1951 | Bodle et al. | 62/23 |
| 2,582,148 | 1/1952 | Nelly, Jr. | 62/23 |

*Primary Examiner*—Norman Yudkoff

*Attorney, Agent, or Firm*—Fetherstonhaugh & Co.

[57] ABSTRACT

A continuous process for the liquefaction of natural gas in which as a first step in the process the pressure of the gas is regulated to an input pressure in excess of 800 PSIG. The gas is then cooled at the input pressure to a temperature of the order of about 0° F. in a primary cooling step. The gas is then expanded in a primary expansion step to reduce the pressure to 600 PSIG or less at a temperature of about 100° F. again cooled in a further cooling step at a pressure of 600 PSIG or less to the critical temperature of the gas and thereafter the gas is expanded in a secondary expansion step to liquefy the gas at the convenient holding pressure for storage. This process provides for the cooling of the gas in a manner which permits re-circulated cooled gas to be used as the cooling medium in the heat exchangers.

6 Claims, 1 Drawing Figure

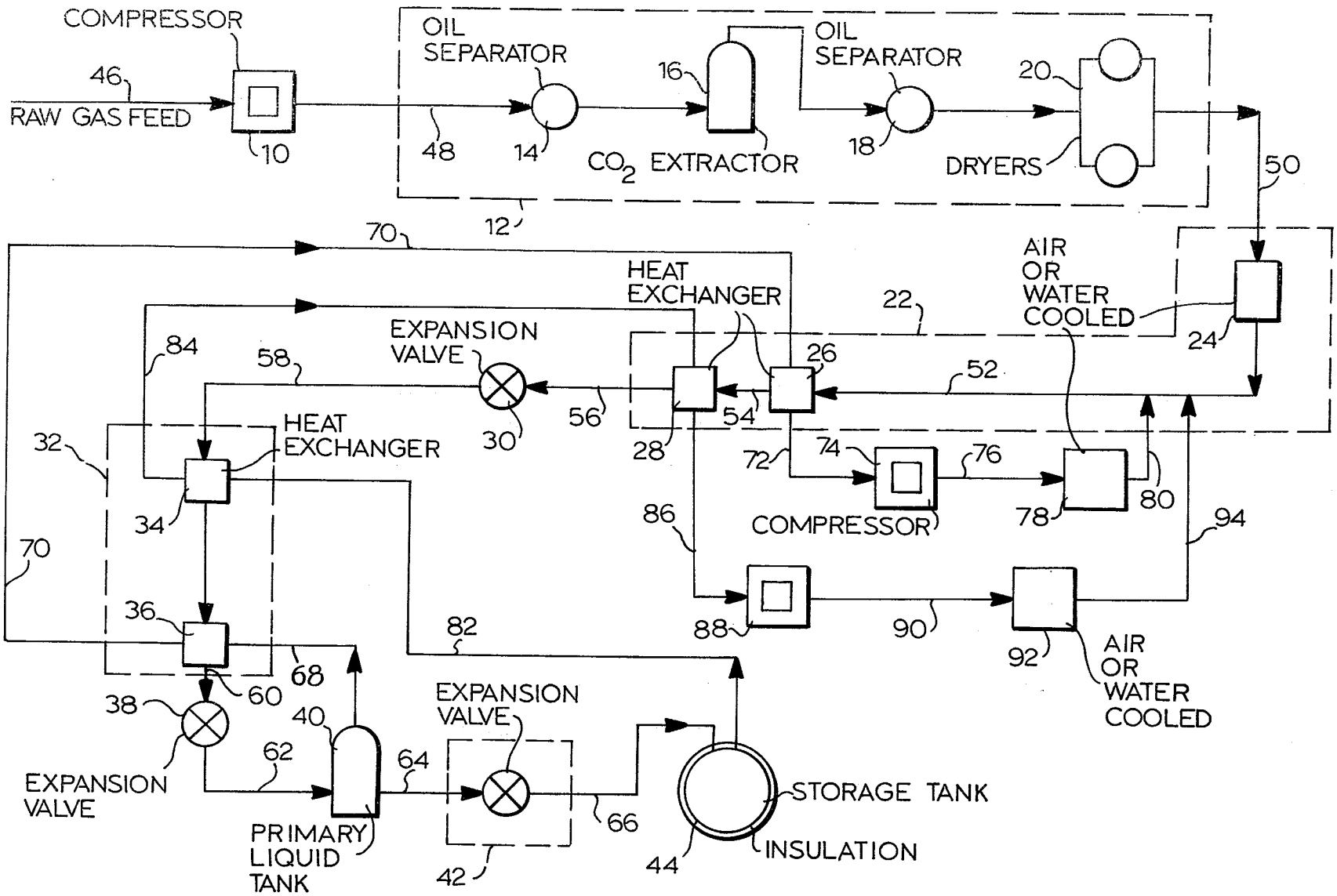
COMPRESSOR
RAW GAS FEED
OIL SEPARATOR
$CO_2$ EXTRACTOR
OIL SEPARATOR
DRYERS
AIR OR WATER COOLED
HEAT EXCHANGER
EXPANSION VALVE
HEAT EXCHANGER
COMPRESSOR
AIR OR WATER COOLED
STORAGE TANK
INSULATION
EXPANSION VALVE
PRIMARY LIQUID TANK
EXPANSION VALVE

PROCESS FOR LIQUEFACTION OF NATURAL GAS

This is a continuation of application Ser. No. 693,767 filed June 8, 1976, now abandoned.

FIELD OF INVENTION

This invention relates to the liquefaction of natural gas.

PRIOR ART

In known liquefaction process for natural gas and methane ethylene-ammonia cascade heat exchangers have been used. Gas at 600 PSI was cooled to −139° F. and thereafter expanded to 55 PSIG in a first expansion and thereafter expanded in a second expansion to 10 PSIG at −258° F. to form liquid in a condition suitable for storage. By reason of the fact that in the known process the primary cooling takes place when the gas is at a pressure of about 600 PSI it has been necessary to provide heat exchangers in which the cooling medium is ammonia and ethylene in order to obtain the required cooling of the gas at 600 PSIG to −139° F. In the known process any leakage of natural gas into the refrigeration circuit would result in contamination of the refrigerant which would be likely to render the refrigeration system inoperative. In addition, it is necessary to provide additional sources of auxiliary power in order to operate the ammonia and the ethylene cooling systems.

The present invention overcomes the difficulties of the prior art described above. In the process of the present invention the pressure of the natural gas is regulated pressure in excess of 800 PSI before the gas is subjected to the primary cooling step. Gas which has been cooled in the primary cooling step at the elevated pressure may be expanded in a primary expansion step to about 600 PSIG at a temperature of about −100° F. Considerable difficulty would be experienced with the conventional process in attempting to cool gas at 600 PSIG to a temperature of the order of about −100° F. in the primary cooling step without the aid of a separate refrigeration system. It has been found that by regulating the pressure of the gas at input to a pressure in excess of 800 PSIG, preferably about 1500 PSIG, it is possible to obtain all of the necessary cooling in the primary cooling step by re-circulating a portion of the cooled natural gas. In areas such as Artic gas fields an ample supply of cold air and cold water is available to supplement the primary cooling step.

SUMMARY OF INVENTION

According to one aspect of the present invention, there is provided a continuous process for the liquefaction of natural gas which comprises the steps of, regulating the pressure of the continuously flowing stream of natural gas to an input pressure in excess of 800 PSIG, cooling the continuously flowing stream of natural gas at the input pressure to a temperature of the order of about 0° F. in a primary cooling step, expanding natural gas in a primary expansion step to reduce the pressure to 600 PSIG or less at a temperature of about −100° F., cooling the natural gas at 600 PSIG or less to liquefy the gas at the critical temperature of the gas in a secondary cooling step and reducing the pressure of the liquefied natural gas in a secondary pressure reduction step to a convenient holding pressure for storage.

According to a further aspect of the present invention there is provided a continuous process for the liquefaction of the natural gas, comprising the steps of; regulating the pressure of a continuously flowing stream of natural gas to an input pressure in excess of 800 PSIG, cooling the stream of natural gas at said input pressure in a three stage primary cooling step in which; the first stage provides the cooling to a temperature of about 40° F. and the second and third stages combine to provide for cooling to a temperature of about 0° F., expanding the stream of natural gas in a primary expansion step to reduce the pressure to 600 PSIG or less and a temperature of about −100° F., cooling the natural gas stream in a two stage secondary cooling step in which; the first and second stages combine to cool the natural gas to about −139° F. at a pressure of about 600 PSIG, to thereby liquefy the gas, reducing the pressure of the stream of liquefied gas in a secondary pressure reduction step to a pressure of about 55 PSIG and a temperature of about −218° F., admitting the liquefied gas to a primary liquid collector reducing the pressure of the stream of liquefied gas in a tertiary expansion step to a pressure of about 10 PSIG at a temperature of −258° F. so that the liquefied gas is in a condition suitable for storage.

PREFERRED EMBODIMENT

The invention will be more clearly understood with reference to the drawings wherein;

The FIGURE is a diagram illustrating a natural gas liquefaction process according to an embodiment of the present invention.

With reference to the FIGURE, the reference numeral 10 refers generally to a pressure regulating device which is generally in the form of a compressor. Gas scrubbing equiment is generally identified by the reference numeral 12 and may consist of a first oil separator 14, a $CO_2$ extraction device 16, a second oil separator 18 and driers 20. The reference numeral 22 refers generally to a three-stage heat exchanger which includes a first-stage heat exchanger 24, a second-stage heat exchanger 26 and a third-stage heat exchanger 28. The reference numeral 30 refers generally to a primary expansion valve. A two-stage secondary heat exchanger is generally identified by the reference numeral 32 and includes a first-stage heat exchanger 34 and a second-stage heat exchanger 36. The reference numeral 38 refers generally to a secondary expansion valve. A primary liquid holding tank is generally identified by the reference numeral 40. A third expansion or pressure reducing valve is generally identified by the reference numeral 42. The liquid storage tank in which the liquefied natural gas is stored is generally identified by the reference numeral 44.

In use, raw natural gas at any pressure is fed through input line 46 to the regulator 10. As previously indicated, the regulator 10 is generally in the form of a compressor and serves to compress the input gas to a pressure in excess of 800 PSIG and preferably in the range of 800 PSIG to 1500 PSIG. It will be understood that in certain applications where the gas is obtained from a high pressure source, it may not be necessary to compress the gas, in which case the regulator 10 merely serves to regulate the flow of gas to a substantially constant pressure within the range previously specified. The gas is discharged from the regulator 10 to the scrubber units through line 48. The scrubber units may be of any conventional configuration for preparing the natural gas for liquefaction. The natural gas is discharged from the scrubbing units through line 50 to the primary heat exchanger 22 at a pressure in excess of 800 PSIG and preferably of the order of about 1500 PSIG. The gas is cooled in the first-stage heat exchanger 24 which is an air of water cooled heat exchanger. In applications such as Arctic installations, an adequate source or cold air and cold water is available from natural sources for this first-stage. Preferably, the gas is cooled in this first stage to a temperature of about 40° F. while the pressure remains substantially constant at the input pressure which, as previously indicated, is above 800 PSIG. The gas is discharged from the first-stage heat exchanger 24 through line 52 to the second-stage heat exchanger 26 and thereafter through the line 54 to the third-stage heat exchanger 28. The combined cooling effect of the second and third-stage heat exchangers 26 and 28 is such that the natural gas is cooled to a temperature of the order of about 0° F. at discharge from the third-stage heat exchanger into the line 56. The natural gas in line 56 is at a temperature of 0° F. and a pressure substantially equal to the input pressure which, as previously indicated, is in excess of 800 PSIG and preferably of the order of about 1500 PSIG. The gas is then expanded through the expansion valve 30 in a primary expansion step to reduce the pressure to 600 PSIG or less to effect a cooling of the gas to a temperature of about −100° F. at discharge into the line 58.

The gas in the line 58 is fed to the secondary heat exchanger 32 wherein it passes through the first-stage heat exchanger 34 and thereafter through the second-stage heat exchanger 36 which combine to cool the gas to a temperature of about −139° F. at a pressure of about 600 PSIG and thereby liquefy the gas. The liquefy gas at this pressure and temperature passes to the secondary expansion valve 38 through line 60. The liquefied gas has its pressure reduced by passage through pressure reducing valve 38 to a pressure of about 55 PSIG and a temperature of about −218° F. The liquefied gas passes from the secondary pressure reducing valve 38 to the primary liquid storage tank 40 through line 62. Liquefied gas from the primary liquid tank passes to the tertiary pressure reducing valve 42 through line 64. The pressure in the liquefied gas is reduced as a result of its passage through the tertiary pressure reducing valve 42 to a pressure of about 10 PSIG and a temperature of −258° F. The liquefied gas is then transferred to the liquid storage tank 44 through line 66.

A portion of the liquefied gas, at a temperature of −218° F., is recirculated as a cooling medium and is fed from the primary liquid storage tank 40 through line 68 to the second-stage heat exchanger 36 of the secondary heat exchanger 32, in which the liquefied gas is generally vapourized, and thereafter it passes through line 70 to the second-stage heat exchanger 26 of the primary heat exchanger 22. The gas is then directed to a compressor 74 through line 72. The gas is compressed by the compressor 74 to a pressure which is compatible with the pressure in the line 52 to which is is readmitted through line 76, heat exchanger 78 and line 80. The heat exchanger 78 may be an air of water heat exchanger and serves to control the temperature of the gas in the line 80 to a temperature compatible with that in the line 52.

Because of inevitable heat losses in the storage tank 44. A portion of the stored liquefied natural gas will vapourize and this vapourized natural gas at a temperature of −258° F. is re-circulated from the storage tank 44 through line 82 to the first-stage heat exchanger 34 of the secondary heat exchanger 32 and thereafter through line 84 to the third-stage heat exchanger 28 of the primary heat exchanger 22. The gas is discharged from the third-stage heat exchanger 28 through line 86 to compressor 88 in which its pressure is increased to a pressure compatible with the pressure in the line 52 and thereafter it is discharged through line 90 to heat exchanger 92 in which its temperature is adjusted to a temperature compatible with the temperature of the gas in the line 52. The gas is then readmitted to the line 52 through line 94.

As indicated above, the cooling medium for the heat exchangers 36 and 26 is re-circulated natural gas from the primary liquid tank 40 which is thereafter readmitted to the line 52. Similarly the cooling medium for the heat exchangers 34 and 28 is re-circulated natural gas from the storage tank 44 which is also re-admitted to the line 52. The cooling medium for the heat exchangers 78 and 92 may be air or water.

The process as it is applied to the liquefaction is such that the pressure of the natural gas at input is regulated in the regulator 10 to a pressure in excess of 800 PSIG, preferably about 1500 PSIG, the gas is thereafter cooled in the air or water cooled heat exchanger 24 to a temperature of about 40° F. and thereafter it is cooled in the heat exchangers 26 and 28 to a temperature of about 0° F. The pressure is then reduced from the input pressure through the expansion valve 30 to a pressure of 600 PSIG at a temperature of −100° F. The gas is then cooled in the secondary heat exchanger in heat exchangers 34 and 36 to a temperature of −139° F. and is thereby liquefied. The liquefied gas then has its pressure reduced from the 600 PSIG to 55 PSIG by passing it through the pressure reduction valve 38. The pressure in liquefied gas is then further reduced by passage through valve 38 to a pressure of 10 PSIG at a temperature of −258° F. under which conditions the liquefied natural gas is stored in the storage tank 44. As previously indicated, cooled natural gas from the primary liquid tank 40 and the storage tank 44 is re-circulated through the secondary heat exchanger and the second and third stages of the primary heat exchanger and readmitted to the primary heat exchanger upstream of the second stage thereof following a pressure and temperature adjustment.

Various modifications of the process of the present invention are possible without departing from the scope of the invention. For example, natural gas supplied from a source having a pressure of the order of about 1500 PSIG need not be compressed to increase its pressure, in which case the pressure regulating device 10 would serve merely to maintain a substantially constant pressure in the input line. In addition, where it is desired to liquefy natural gas which has been previously scrubbed, it is not necessary to provide the scrubber apparatus generally designated by the reference numeral 12.

From the aforegoing, it will be apparent that the present invention provides a simple process for the liquefaction of natural gas in which by adjusting the pressure of the natural gas to a pressure in excess of 800 PSIG, it is possible to effect a major portion of the cooling by recycling the cooled natural gas from the liquid storage tanks. The process of the present invention reduces the cascade cooling process of the prior art from three stages to one stage. The process of the present invention also reduces the power required to obtain liquefaction. The refrigerant in the present process is natural gas and consequently there is no danger of contamination of the natural gas which is being liquefied by the refrigerant and, in fact, the refrigerant is reintroduced into the liquefaction circuit. There is a substantial temperature gradient between the refrigerant and the gas which is being cooled in each of the stages of the heat exchangers which are cooled by recycled natural gas and this feature contributes to the fact that it is possible to effect cooling by the recycling of the cooled natural gas.

These and other advantages of the present invention will be apparent to those skilled in the art without departing from the scope of the invention.

What I claim as my invention is:

1. A continuous process for the liquefaction of natural gas comprising the steps of:

(a) regulating the pressure of the continuously flowing stream of natural gas to an input pressure in excess of 800 PSIG, (b) cooling the continuously flowing stream of natural gas at the input pressure to a temperature of the order of about 0° F. in a multi-stage primary cooling step including a first cooling stage and a plurality of subsequent cooling stages, (c) expanding the natural gas in a primary expansion step to reduce the pressure to 600 PSIG or less and a temperature of about −100° F., (d) cooling the natural gas at 600 PSIG or less in a secondary cooling step to the critical temperature of the gas and (e) expanding the natural gas in a secondary expansion step to liquefy the gas at a convenient holding pressure for storage, (f) a portion of the liquefied gas stream being withdrawn after the secondary expansion step and circulated as a cooling medium in the secondary cooling step and thereafter used as a cooling medium in said subsequent cooling stages of said primary cooling step, and thereafter returned to the continuously flowing stream before said primary expansion step at a point in the primary cooling step between the first cooling stage and said subsequent cooling stages at a pressure above the critical pressure of the natural gas.

2. A process as claimed in claim 1, wherein said input pressure is in the range of 800 to 1500 PSIG.

3. A process as claimed in claim 1, wherein said input pressure is about 1500 PSIG.

4. A continuous process for the liquefaction of the natural gas, comprising the steps of;

(a) regulating the pressure of a continuously flowing stream of natural gas to an input pressure in excess of 800 PSIG, (b) cooling the stream of natural gas at said input pressure in a three stage primary cooling step in which; the first stage provides the cooling to a temperature of about 40° F. and the second and third stages combine to provide for cooling to a temperature of about 0° F., (c) expanding the stream of natural gas in a primary expansion step to reduce the pressure to 600 PSIG or less and a temperature of about −100° F., (d) cooling the natural gas stream in a two stage secondary cooling step in which; the first and second stages combine to cool the natural gas to about −139° F. at a pressure of about 600 PSIG, (e) expanding the stream of gas in a secondary expansion step to a pressure of about 55 PSIG and a temperature of about −218° F., (f) admitting the expanded gas to a primary liquid collector to collect any liquid phase present after said secondary expansion, (g) expanding the stream of gas in a tertiary expansion step to a pressure of about 10 PSIG to liquefy the natural gas at a temperature of −258° F., (h) a portion of the liquefied gas stream being withdrawn after the secondary expansion step and circulated as a cooling medium in the second stage of the secondary cooling step and thereafter circulated as a cooling medium in the second stage of the primary cooling step and is thereafter returned to the continuously flowing stream in the primary cooling step upstream from the second stage thereof at a pressure above the critical pressure of the natural gas, (i) a portion of the gas stream being withdrawn after the tertiary expansion step and circulated as a cooling medium in the first stage of the secondary cooling step and thereafter circulated as a cooling medium in the third stage of the primary cooling step and returned to the continuously flowing stream in the primary cooling step upstream from the second stage thereof at a pressure above the critical pressure of the natural gas.

5. A process as claimed in claim 4 wherein the temperature and pressure of the cooling medium is adjusted to the temperature and pressure of the gas stream prior to the second stage of the primary cooling process and is readmitted to the stream prior to the second stage of the primary cooling step.

6. A process as claimed in claim 4 wherein natural gas from a low pressure source is compressed to increase its pressure to the input pressure in excess of 800 PSIG.

* * * * *